US005550426A

United States Patent [19]

Smith et al.

[11] Patent Number: 5,550,426

[45] Date of Patent: Aug. 27, 1996

[54] FIELD EMISSION DEVICE

[75] Inventors: Robert T. Smith, Mesa; Scott K. Ageno, Phoenix, both of Ariz.

[73] Assignee: Motorola, Schaumburg, Ill.

[21] Appl. No.: 268,748

[22] Filed: Jun. 30, 1994

[51] Int. Cl.[6] ..... H01J 1/30

[52] U.S. Cl. ..... 313/336; 313/309; 257/10

[58] Field of Search ..... 257/10, 11; 313/336, 313/309, 351

[56] References Cited

U.S. PATENT DOCUMENTS

| | | | |
|---|---|---|---|
| 4,370,797 | 2/1983 | van Gorkom et al. | 313/336 |
| 4,766,340 | 8/1988 | van der Mast et al. | 313/336 |
| 5,138,237 | 8/1992 | Kane et al. | 313/308 |
| 5,142,184 | 8/1992 | Kane | 313/336 |
| 5,162,704 | 11/1992 | Kobori et al. | 313/336 |
| 5,191,217 | 3/1993 | Kane et al. | 313/336 |

*Primary Examiner*—Michael Horabik
*Assistant Examiner*—Michael Day
*Attorney, Agent, or Firm*—Robert F. Hightower; Eugene A. Parsons

[57] ABSTRACT

An FED (10) utilizes a semiconductor junction to control the current flow (32) through an emission tip of the FED (10). The semiconductor junction is created between a conductive layer (12) and a doped semiconductor layer (14). The conductive layer (12) can be a metal or another doped semiconductor layer in order to form the semiconductor junction.

14 Claims, 2 Drawing Sheets

FIELD EMISSION DEVICE

BACKGROUND OF THE INVENTION

The present invention relates, in general, to cold-cathode field emission devices, and more particularly, to a field emission device employing a novel current limiting protection scheme.

Field emission devices (FEDs) are well known in the art and are commonly employed for a broad range of applications including image display devices. Examples of such FEDs are described in U.S. Pat. No. 5,191,217 issued to Kane et al. on Mar. 2, 1993, and U.S. Pat. No. 5,142,184 issued to Robert C. Kane on Aug. 25, 1992. Prior FEDs typically have an emitter or emission tip that is utilized to emit electrons that are attracted to a distally disposed anode. A ballast resistor generally is connected in series with the tip to limit current flow through the tip in order to prevent damaging the tip. Because of the large resistor values needed for the ballast resistor, it is difficult to control both the resistivity and the temperature coefficient of semiconductor material in the high resistivity ranges, typically 1000 ohm-centimeter (ohm-cm.) or greater, required for the ballast resistors.

Another problem with these prior FEDs is the high voltage values that must be switched in order to enable and disable the FED. Electron emission typically is disabled by applying a high voltage, about 100 volts, to the emission tip and to the emission grid or gate, conversely, electron emission is enabled by applying a lower voltage, generally about zero volts, to the tip. Switching such large voltages results in high power dissipation in addition to long rise and fall times for the drive signal.

Accordingly, it is desirable to have an FED emission tip current limiting mechanism that does not require precisely controlled resistivity or resistor values, and that does not switch large voltages to enable and disable electron emission.

DETAILED DESCRIPTION OF THE DRAWINGS

Figure 1:
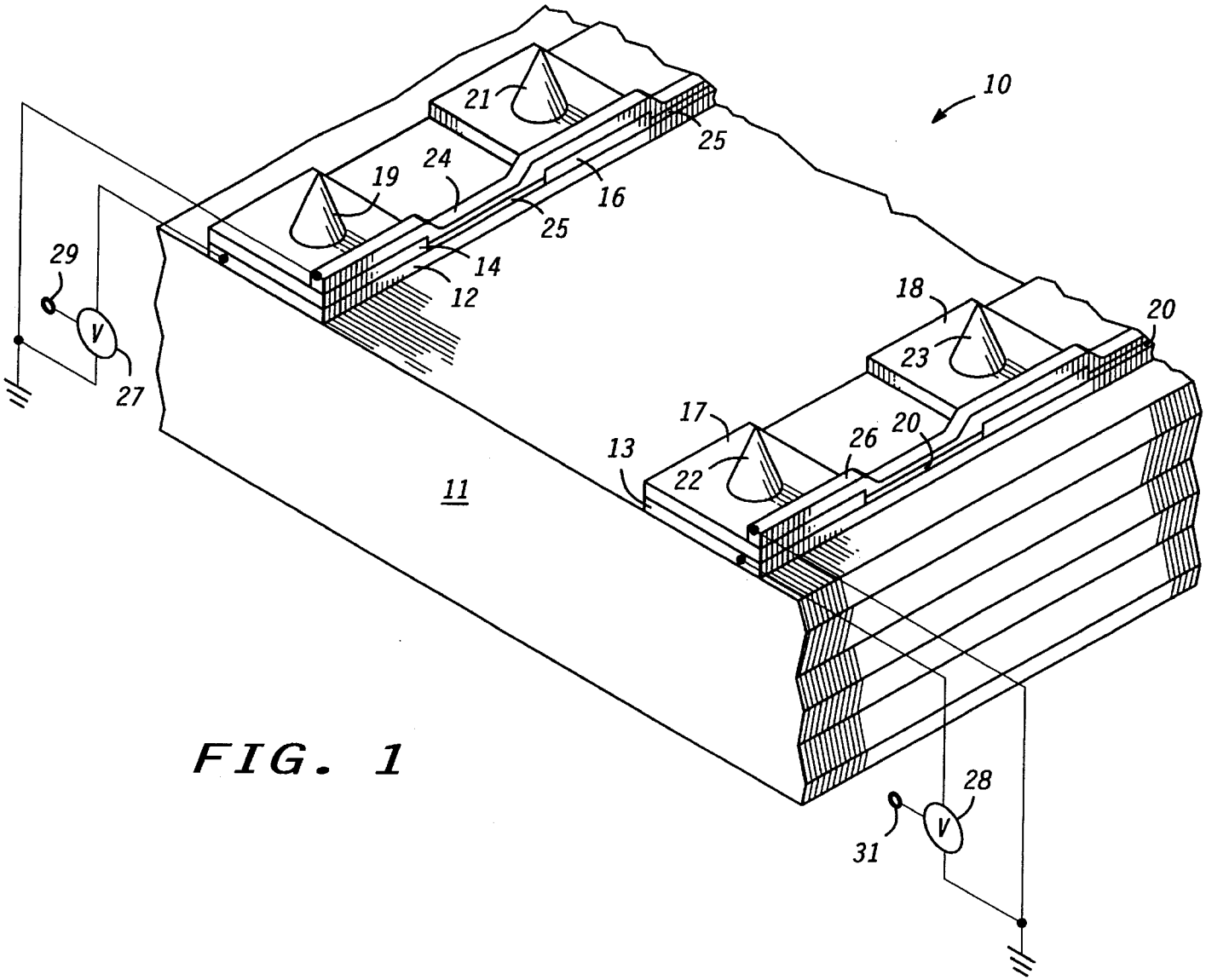
FIG. 1 illustrates a cross-sectional perspective view of a portion of a field emission device in accordance with the present invention.

FIG. 1 illustrates an enlarged cross-sectional perspective view of a portion of a field emission device (FED) 10. For clarity of the illustration and description, other elements of FED 10 have been omitted. Some of these other elements are illustrated hereinafter in FIG. 2. FED 10 includes a substrate 11 on which other elements of FED 10 are formed. Although substrate 11 may be any one of a number of insulating or semiconductor substrates, it is preferable that substrate 11 have a crystalline structure that matches the crystalline structure of elements formed on the surface of substrate 11. In the preferred embodiment, substrate 11 is silicon. A surface of substrate 11 has a first conductive layer 12 and a second conductive layer 13 formed thereon in a pattern corresponding to columns that are used in addressing individual elements of FED 10. Use of columns and column addressing techniques are well known to those skilled in the art. A plurality of doped silicon areas 14 and 16 are disposed on layer 12 and a plurality of doped silicon layers 17 and 18 are disposed on layer 13. Areas 14, 16, 17, and 18 are positioned to correspond to pixel locations of FED 10. Cold-cathode emission tips or cold-cathode emitters 19, 21, 22, and 23 are disposed on areas 14, 16, 17, and 18, respectively. Although individual emitters are illustrated in FIG. 1, it is to be understood that emitters 19, 21, 22, and 23 each could be a plurality of emitters as is well known to those skilled in the art.

The material utilized for areas 14, 16, 17, and 18 is suitable for forming a semiconductor type junction at the interface between layer 12 and areas 14 and 16 in addition to between layer 13 and areas 17 and 18. For example, layers 12 and 13 could be heavily doped N-type silicon and areas 14, 16, 17, and 18 could be lightly doped P-type polysilicon. Layers 12 and 13 generally could be doped between $1\times10^{17}$ to $1\times10^{19}$ atoms/cm$^3$ while areas 14, 16, 17, and 18 could be doped below approximately $1\times10^{17}$ atoms/cm$^3$ in order to ensure that a depletion region formed by the semiconductor junction extends far into area 14. Also, layers 12 and 13 could be a metal and areas 14, 16, 17, and 18 could be a semiconductor material that forms a semiconductor junction with the metal. In the preferred embodiment, layers 12 and 13 are molybdenum and areas 14, 16, 17, and 18 are P-type polysilicon that is doped approximately $1\times10^{14}$ to $1\times10^{16}$ atoms/cm$^3$ with boron. As will be seen hereinafter this junction is utilized to control the amount of current flowing through tips 19, 21, 22, and 23.

A column electrode 24 is utilized to interconnect areas 14 and 16, thus, electrically connecting tips 19 and 21 into a column of FED 10. Electrode 24 is positioned so that current flowing between tip 19 and electrode 24 must flow through area 14, and current flowing between tip 21 and electrode 24 flows through area 16. Similarly, a column electrode 26 is utilized to interconnect areas 17 and 18 in order to electrically connect tips 22 and 23 into another column of FED 10. A dielectric 25 insulates electrode 24 from layer 12, and a dielectric 20 insulates electrode 26 from layer 13. A dependent voltage source 27 has an output voltage that is controlled by the voltage applied to a control input 29. A negative terminal of source 27 is connected to ground and a positive terminal is connected to layer 12. The function of source 27 is explained hereinafter in the description of FIG. 2. Similarly a dependent voltage source 28 is controlled by the voltage applied to a control input 31. The negative terminal of source 28 is connected to ground and the positive terminal is connected to layer 13. Both electrodes 24 and 26 are connected to ground.

Figure 2:
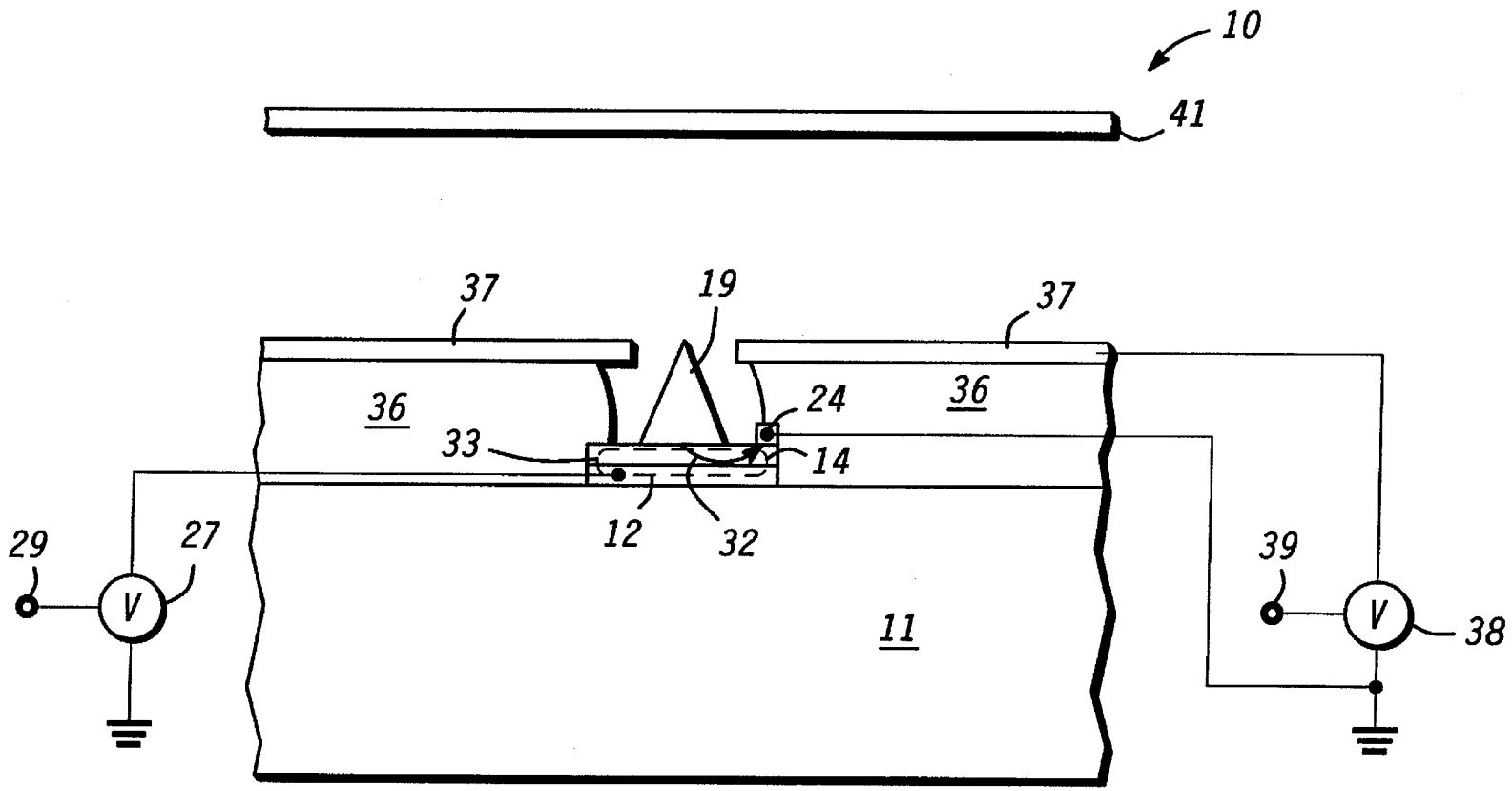
FIG. 2 illustrates a cross-sectional portion of the field emission device of FIG. 1 showing other elements in accordance with the present invention.

FIG. 2 is an enlarged cross-sectional view of a portion of FED 10 illustrated in FIG. 1. Elements of FIG. 2 that are the same as FIG. 1 have the same reference numerals. FIG. 2 illustrates only a portion of layer 12 and area 14 for simplicity of the explanation. However, the description applies to other similar elements of FED 10. FIG. 2 also illustrates additional elements of FED 10 that are not shown in FIG. 1. These new elements include an insulating layer 36 that is used to support a gate or emission grid 37. Also, an anode 41 is shown distally disposed from grid 37. As indicated in the discussion of FIG. 1, source 27 is connected to layer 12, and electrode 24 is connected to ground. Additionally, a dependent voltage source 38 having a control input 39 has a positive output connected to grid 37 and a negative terminal connected to ground. The voltage applied to grid 37 causes electrons to be emitted from tip 19, pass through the opening in grid 37 and strike anode 41. It should be noted, that grid 37 is not required to produce electron emission, that is, emission can be sustained between emitter 19 and anode 41 without grid 37.

The voltage applied to layer 12 by source 27 controls the amount of current flowing between tip 19 and electrode 24. The junction at the interface of layer 12 and area 14 forms a depletion region 33, illustrated by dashed lines. This depletion region facilitates controlling current flow to tip 19. When the output voltage of source 27 is zero volts, depletion region 33 is small and current flows between tip 19 and electrode 24 as shown by an arrow 32. As the output voltage of source 27 is increased, the size of depletion region 33 increases. Depletion region 33 reduces the amount of area 14 through which current can flow thereby reducing the amount of current flowing between tip 19 and electrode 24. As the output voltage of source 27 continues to increase, depletion region 33 eventually pinches-off the current flowing between tip 19 and electrode 24. Typically, the voltage required to pinch-off current 32 depends upon the thickness of area 14 and the doping of layer 12 and area 14. As indicated in the description of FIG. 1, the doping of layer 12 and area 14 is chosen so that the depletion region extends far into area 14 in order to pinch-off current 32. In the preferred embodiment, a voltage of less than approximately four volts is sufficient to completely pinch-off current 32. Consequently, a low voltage, less than approximately four volts, enables and disables electron emission from tip 19. Switching only four volts instead of the approximately one hundred volts of prior FEDs reduces the power dissipation of the FED and reduces the amount of current needed to maintain the required rise and fall times of the FED drive signal.

By now it should be appreciated that there has been provided a novel way to control the emission current of an FED. Utilizing a semiconductor junction to form a depletion region within a conductor carrying the emission current, facilitates utilizing the depletion region to control electron emission of the FED. Because only a small voltage is required to make a large change in the width of the depletion region, the small voltage is sufficient to control the emission current, thus, the intensity of the image displayed by the FED. This is much less than the large, approximately 100 volts, that must be switched to control prior art FEDs and results in lower switching power dissipation and improved display resolution.

We claim:

1. A field emission device comprising:

a substrate;

a conductive layer on the substrate;

a doped semiconductor layer on the conductive layer wherein a semiconductor junction is formed between the conductive layer and the doped semiconductor layer; and an emission tip on the doped semiconductor layer, the emission tip overlying the semiconductor junction wherein current flowing through the emission tip flows through the doped semiconductor layer but not through the semiconductor junction.

2. The device of claim 1 wherein the conductive layer is a metal that forms the semiconductor junction with the doped semiconductor layer.

3. The device of claim 2 wherein the metal is molybdenum.

4. The device of claim 1 wherein the doped semiconductor layer has a doping concentration less than $1\times10^{17}$ atoms/$cm^3$.

5. The device of claim 1 wherein the conductive layer is a doped semiconductor material.

6. The device of claim 5 wherein the doped semiconductor material is doped polysilicon.

7. The device of claim 6 wherein the doped polysilicon has a doping concentration of $1\times10^{14}$ and $1\times10^{16}$ atoms/$cm^3$.

8. The device of claim 5 wherein the doped semiconductor material is doped single crystal silicon.

9. A field emission device comprising:

a substrate;

a conductive layer on the substrate;

a doped semiconductor layer on the conductive layer wherein a semiconductor junction is formed between the conductive layer and the doped semiconductor layer;

an emission tip on the doped semiconductor layer, the emission tip overlying the semiconductor junction; and a column electrode on the doped semiconductor layer.

10. A cold-cathode emitter comprising:

an emission tip;

a doped semiconductor layer coupled to the emission tip wherein current flowing through the emission tip also flows through the doped semiconductor layer; and a conductive layer adjacent the doped semiconductor layer wherein a semiconductor junction is between the doped semiconductor layer and the conductive layer wherein the current flowing through the emission tip does not flow through the semiconductor junction.

11. The emitter of claim 10 wherein the doped semiconductor layer has a doping concentration less than $1\times10^{17}$ atoms/$cm^3$.

12. The emitter of claim 10 wherein the conductive layer is a metal that forms the semiconductor junction with the doped semiconductor layer.

13. The emitter of claim 10 wherein the conductive layer is a doped semiconductor material.

14. A cold-cathode emitter comprising:

an emission tip;

a doped semiconductor layer coupled to the emission tip wherein current flowing through the emission tip also flows through the doped semiconductor layer; and a conductive layer adjacent the doped semiconductor layer wherein a semiconductor junction is between the doped semiconductor layer and the conductive layer; and a depletion region having a width formed by the semiconductor junction wherein the width of the depletion region controls the current flowing through the emission tip.

* * * * *